US010072432B2

(12) United States Patent
Weijers et al.

(10) Patent No.: US 10,072,432 B2
(45) Date of Patent: Sep. 11, 2018

(54) SWIMMING POOL WITH ADJUSTABLE POOL FLOOR SYSTEM

(71) Applicant: Variopool B.V., Oudkarspel (NL)

(72) Inventors: Theodorus Marcelis Cornelis Weijers, Oudkarspel (NL); Marco Bernardus Wiebren Coesel, Oudkarspel (NL)

(73) Assignee: Variopool B.V., Oudkarspel (NL)

( * ) Notice: Subject to any disclaimer, the term of this patent is extended or adjusted under 35 U.S.C. 154(b) by 275 days.

(21) Appl. No.: 14/439,285

(22) PCT Filed: Oct. 29, 2013

(86) PCT No.: PCT/NL2013/050765

§ 371 (c)(1),
(2) Date: Apr. 29, 2015

(87) PCT Pub. No.: WO2014/069999

PCT Pub. Date: May 8, 2014

(65) Prior Publication Data

US 2015/0292220 A1 Oct. 15, 2015

(30) Foreign Application Priority Data

Oct. 30, 2012 (GB) ..... 1219508.7

(51) Int. Cl.
*E04H 4/06* (2006.01)
*F15B 15/14* (2006.01)

(52) U.S. Cl.
CPC ..... *E04H 4/065* (2013.01); *F15B 15/14* (2013.01)

(58) Field of Classification Search
CPC ..... E04H 4/065; E04H 4/084; E04H 4/103; E04H 4/105; E04H 4/106; F16L 5/10; F16L 5/025
USPC ..... 4/495, 498–501, 504, 506, 557–558; 254/89 H, 93 R, 93 L; 138/31; 403/288; 16/2.2; 277/314, 355, 357, 527, 603, 277/607, 634, 642
See application file for complete search history.

(56) References Cited

U.S. PATENT DOCUMENTS 3,435,465 A * 4/1969 Formel ..... E04H 4/065 4/495
3,553,743 A 1/1971 Lodige
3,670,343 A * 6/1972 Gansloser ..... E04H 4/065 4/495
3,864,262 A * 2/1975 Lang ..... E04H 4/1209 210/167.14

(Continued)

FOREIGN PATENT DOCUMENTS

EP 0 532 079 A1 3/1993
EP 0532079 * 3/1993 ..... E04H 4/06

(Continued)

*Primary Examiner* — Erin Deery
*Assistant Examiner* — Nicholas Ros
(74) *Attorney, Agent, or Firm* — Lindsey A. Auerbach; Catherine A. Shultz; NLO N.V.

(57) ABSTRACT

The invention relates to an adjustable swimming pool floor system (40). In addition, the invention relates to a swimming pool (5) comprising such an adjustable pool floor system. Furthermore, the invention relates to a method for installing the hydraulic system (1) in a swimming pool. The invention also relates to a hydraulic system for use in an adjustable swimming pool floor system.

26 Claims, 4 Drawing Sheets

(56) References Cited

U.S. PATENT DOCUMENTS 4,244,627 A * 1/1981 Hastings, Jr. ..... F15B 15/1433 254/93 R
4,476,772 A 10/1984 Gorman et al.
4,771,221 A * 9/1988 Finkbeiner ..... B66F 3/46 254/89 H
5,165,700 A * 11/1992 Stoll ..... F16J 15/3232 277/550
5,271,483 A 12/1993 Hong
6,484,620 B2 * 11/2002 Arshad ..... F02B 77/08 91/1
7,191,038 B2 * 3/2007 Green ..... B66F 7/04 254/45
7,478,839 B2 * 1/2009 Barber ..... F16L 27/10 277/603
7,617,546 B1 11/2009 Hill
8,001,626 B2 * 8/2011 Dalickas ..... E04H 4/06 4/498
2008/0207034 A1 * 8/2008 Aita ..... F16L 5/025 439/277
2011/0018210 A1 * 1/2011 Beele ..... F16L 5/10 277/606
2011/0031802 A1 2/2011 Dunigan
2011/0308004 A1 * 12/2011 Khorsandraftar ..... E04H 4/065 4/504

FOREIGN PATENT DOCUMENTS

FR 2 050 544 A5 4/1971
FR 2 949 244 A1 2/2011
JP 2003-239554 A 8/2003
JP 2003239554 * 8/2003 ..... E04H 4/06
NL 7407358 A 12/1975
WO 2012/116420 A1 9/2012

* cited by examiner

SWIMMING POOL WITH ADJUSTABLE POOL FLOOR SYSTEM

CROSS-REFERENCE TO RELATED APPLICATIONS

The present application is the National Stage filing of International Application No. PCT/NL2013/050765, filed Oct. 29, 2013, which claims the benefit of GB 1219508.7 filed Oct. 30, 2012, the entire contents of all of which are incorporated by reference herein.

BACKGROUND OF THE INVENTION

1. Field of the Invention

The invention relates to an adjustable swimming pool floor system. In addition, the invention relates to a swimming pool comprising such an adjustable pool floor system. Furthermore, the invention relates to a method for installing the hydraulic system in a swimming pool. The invention also relates to a hydraulic system for use in an adjustable swimming pool floor system.

2. Description of the Related Art

Systems to adjust the height of pool floor in a swimming pool come in many varieties. One example is a scissor system that pulls and pushes the pool floor for obtaining respectively a deeper or shallower swimming pool. Another example is a pull system that uses chains or cables and winches to lift and lower a pool floor to obtain the desired depth.

A further example is a system that uses a buoyant pool floor that needs to be pulled downward to obtain a greater depth and is released to obtain a shallower depth. For such a system chains or cables connected to winches may be used to wind down the floor.

Another possibility is to use a hydraulic system to pull the cables or chains for lowering the pool floor. Such a hydraulic system is described in the European patent publication EP0532079. This document describes a swimming pool with an adjustable intermediate floor which has its own buoyancy. At the underside of the pool floor intermediate floor cables are fastened, which cables run by means of pulleys on the pool bottom to a hydraulic movement mechanism, with the aid of which the intermediate floor can be pulled under the water surface and held at a desired position. The cylinder barrels of the hydraulic cylinders of the hydraulic movement mechanism are arranged, sealed and slideably through a vertical wall of the pool near its bottom. The piston rods are fixed outside the pool, and the ends of the cylinder barrels project into the pool, each bearing a pulley head for the cables.

A disadvantage of this hydraulic movement system is that the cylinder barrel, which contains hydraulic fluid, usually oil, extends into the actual pool. If the cylinder barrel is defective, oil may leak into the pool water, thereby contaminating the water such that it is not suitable for swimming. In addition, the oil may cling to parts of the swimming pool in contact with the contaminated water including filters, pumps and other system components. Cleaning the water and in addition the contaminated parts is tedious work and may require considerable time and expense.

Another disadvantage of locating the cylinder within the pool is that access to the cylinder is complicated. Installation, servicing and replacement of parts of the system provided on or in the cylinder is difficult without removing the full installation—often requiring draining of the pool.

A further disadvantage is that due to the sliding of the cylinder barrel in the wall opening, safety devices to prevent the hydraulic system from becoming overloaded, especially the hydraulic cylinder, are difficult to install adjacent to the cylinder barrel.

It would therefore be desirable to provide an alternative hydraulic system that alleviates at least some of the perceived inconveniences of the prior art.

BRIEF SUMMARY OF THE INVENTION

According to the invention there is provided an adjustable swimming pool floor system, comprising a buoyant pool floor adjustable in a height direction relative to a pool bottom of the swimming pool, a hydraulic system and a movement transfer arrangement. The hydraulic system comprises a hydraulic cylinder, comprising a cylinder barrel with a cylinder head and cylinder cap, a piston slideably arranged within the cylinder barrel and a piston rod carried by the piston, whereby a first part of the piston rod extends outside of the cylinder barrel beyond the cylinder head and is extendable into an interior of a swimming pool, and a sealing arrangement enclosing the first part of the piston rod remote from the cylinder head, whereby the sealing arrangement is connectable to the peripheral pool wall enclosing the swimming pool. The pool wall has an opening from the exterior side to an interior side of the pool wall for extending the first part of the piston rod into an interior of the swimming pool adjacent the interior side of the pool wall. The sealing arrangement prevents leakage of liquid from the swimming pool to the exterior side of the pool wall and also prevents contamination from entering the pool along the piston rod. The movement transfer arrangement is connected at a first end to the first part of the piston rod remote from the cylinder head and at a second end to the buoyant pool floor, such that in use movement of the hydraulic cylinder is transferred to the pool floor and adjustment of the pool floor in the height direction is achieved.

The buoyant pool floor can be any floor that has a low density compared to water, such that it has its own buoyancy. In order to adjust the depth of a swimming pool with such a buoyant pool floor, the hydraulic system needs only to apply a force to pull the pool floor towards the pool bottom. By releasing the force, the pool floor will be lifted by its own buoyancy to a shallower depth. In the present context, it will also be understood that although reference is made to a swimming pool, this term is intended to encompass any pool incorporating a moveable bottom, including diving pools, therapy pools and the like.

In order to transfer the pulling force of the hydraulic system, a movement transfer arrangement is provided. The skilled person will be aware that various arrangements are possible including levers, rods, gears and the like. Preferably, the movement transfer arrangement comprises a pulley system connected between the first end of the piston rod and the pool floor, whereby the pulley system converts a movement of the piston rod in one direction into a movement of the pool floor in the height direction. Preferably, the direction of the movement of the piston rod has at least a horizontal component. In general, will be understood the piston rod will be mounted to move in a direction perpendicular to the pool wall. The pulley system can comprise at least one pulley wheel and a tensile member interacting with the pulley and connected with a first end to the first end of the piston rod and with a second end to the pool floor. The tensile member can comprise any suitable member, including but not limited to cords, ropes, cables, chains or a combination thereof.

The hydraulic system may comprise two or more hydraulic cylinders, such that the pool floor can be adjusted in a balanced way. Preferably, the hydraulic system comprises four hydraulic cylinders, each at a corner of the adjustable pool floor.

The sealing arrangement encloses the first part of the piston rod and can be connected to at least an exterior side of the peripheral pool wall. It forms a barrier between the hydraulic cylinder and the interior of the pool. Hereby leakage of water from the swimming pool is prevented, but in addition it is prevented that hydraulic fluid from the cylinder barrel can enter the swimming pool. Contamination of the swimming pool water with the hydraulic fluid is therefore prevented. In addition, by using the piston rod as the part of the hydraulic system to move the adjustable pool floor, it is no longer necessary to locate the cylinder barrel within the interior of the swimming pool. Contamination of the swimming pool water upon leakage of hydraulic fluid through failure of the barrel is prevented in that way.

The hydraulic cylinder may be actuated in any conventional manner. Preferably, the system comprises a processor controlled hydraulic circuit for causing movement of the piston within the cylinder barrel and a user interface for selecting a height of the pool floor relative to the pool bottom. The user interface may be situated at a location remote from the hydraulic system and can be an electronic panel with push buttons, a computerized touch screen or any other suitable interface. Preferably, the hydraulic circuit comprises a pump for pumping the hydraulic fluid, usually oil. However, any actuating means that can exert a force on a fluid or causes a pressure difference in a fluid is suitable.

One way of causing a pressure difference in the hydraulic cylinder is that the piston divides an interior of the cylinder barrel into a first part between the piston and the cylinder head and a second part between the piston and the cylinder cap and the hydraulic circuit comprises a fluid connection tube between the first and the second part of the interior of the cylinder barrel, whereby the fluid connection tube is provided at an exterior of the cylinder barrel. The transportation of the hydraulic fluid between the two interior parts causes movement of the piston. As the cylinder barrel is positionable at the exterior side of the pool wall, a simple fluid connection between the two interior parts of the cylinder barrel can be obtained. The fluid connection tube can be connected to the actuating means. The actuating means may comprise a hydraulic aggregate positioned at a location near or more remote from the hydraulic cylinder, comprising a pump, valves and connection tubes to connect the aggregate to the fluid connection tube.

Preferably, the cylinder barrel is further provided with a pressure indicator to indicate low pressure in the interior of the cylinder barrel. On detection of a pressure below a given value, a signal may be given. A low pressure in the cylinder can indicate the fact that the pool floor is overloaded, due to the presence of two many people or faulty buoyancy.

According to one embodiment, the cylinder may also be provided with a non-return valve arranged to maintain the pressure in the interior of the cylinder barrel in the event of failure of the hydraulic circuit. Under normal operation, the actuating means controls the pressure in the interior parts of the cylinder barrel. The non-return valve may be provided at or close to the fluid connection to the cylinder, such that in the event of failure of the actuating means or the connection between the actuating means and the cylinder barrel the pressure within the cylinder barrel interior parts is maintained According to an important aspect of the invention, in one embodiment, the adjustable floor system comprises a detector for detecting a position of the piston rod with respect to the cylinder. The detector may measure a distance between the piston and the cylinder cap, which distance is in use can serve as a measure for a position of the pool floor in the swimming pool. Most preferably the detector is provided at the cylinder cap. As the piston rod is used as the part of the hydraulic cylinder to move the adjustable pool floor, the cylinder cap opposite the cylinder head can be used to install a detector for detecting the distance between the cylinder cap and the piston. By providing the detector at the cylinder cap and therefore at the exterior of the cylinder barrel, the detector can be quickly replaced. Preferably, the detector is a linear sensor, such that the position of the pool floor has a linear relationship with the distance between the piston and the cylinder cap. The output of the detector may be used to provide feedback to the processor controlled hydraulic system.

Preferably, the sealing arrangement comprises a radially extending first flange connectable to the exterior side of the pool wall. The first flange can seal against the exterior side of the pool wall by comprising a gasket. It can also serve as a guide for the piston rod that extends through the pool wall or as a connection between the hydraulic cylinder and the swimming pool upon installation. A combination of these functions is possible as well.

According to an embodiment, the sealing arrangement comprises a bush slideably enclosing the first part of the piston rod and extending in an axial direction over a length corresponding to a distance between the exterior side and the interior side of the pool wall. It will be understood that the bush need not extend exactly the full thickness of the pool wall but that it advantageously occupies a significant portion of this thickness. The bush encloses the first part of the piston rod such that the piston rod can slide within the bush. The bush is connected to the opening in the pool wall, such that the piston rod can still move to adjust the depth of the pool floor without water escaping from the pool.

According to a further important aspect of the invention, the bush preferably comprises an inner sleeve slideably enclosing the first part of the piston rod and an outer sleeve slideably enclosing the inner sleeve. The inner sleeve guides the piston rod upon moving and the outer sleeve can be connected to the pool wall, thereby positioning the hydraulic system relative to the pool wall. Such a two-part bush arrangement for mounting a hydraulic cylinder to a swimming pool wall is believed to be in itself both new and inventive over prior art constructions. Preferably, at least one of the first and second sleeves comprises polymer material, such as one of high density polyethylene (HDPE) and polyvinylchloride (PVC). More preferably, the inner sleeve comprises a relatively soft polymer material, such as high density polyethylene (HDPE), and the outer sleeve comprises a relatively hard polymer material, such as polyvinylchloride (PVC). HDPE and PVC have been found particularly suitable due to their relatively high chemical resistance, such that deterioration of the sleeves when in contact with both the hydraulic fluid, e.g. oil, and the swimming pool water, e.g. water with chlorine, is prevented or at least decreased. In addition, HDPE and PVC have good mechanical properties, such as a relatively high strength for both materials, a relatively low friction coefficient for HDPE, such that the piston rod can easily slide within the inner sleeve, and additionally a relatively low water absorption rate for HDPE, such that the inner sleeve will prevent water from exiting the swimming pool through the inner sleeve.

As the piston rod comes in contact with both the swimming pool water and the hydraulic fluid, contamination of both fluids with each other should be prevented. Therefore, a wiping element is preferably provided at an end of the bush facing away from the cylinder head, such that upon extension of the piston rod into the swimming pool any hydraulic fluid is wiped off and kept within the bush. Upon retraction of the piston rod into the bush, the swimming pool water may be wiped off and left in the swimming pool. The wiping element may be any conventional element used for this purpose in hydraulic circuits. Most preferably, it comprises a plurality of lips formed in an inner circumference of the bush engaging tightly with the piston rod.

In an alternative embodiment, the sealing arrangement can comprise a second flange connectable to the interior side of the pool wall, opposite the first flange at the exterior side of the pool wall. This may be useful in the case that the adjustable pool floor system is to be installed in a swimming pools with relatively thin pool walls, such as pool walls made of plate material. The first and second flanges can further be provided with gaskets facing the exterior and the interior sides of the pool wall respectively. The sealing arrangement can be positioned remote from the cylinder head, such that the piston rod runs freely and uncovered between the first flange and the cylinder head at the exterior of the swimming pool. In order to avoid hydraulic fluid being transferred to the interior of the swimming pool, a wiping element may be provided at the cylinder head, such that the hydraulic fluid is wiped off the piston rod upon exiting the cylinder barrel and before entering the sealing arrangement.

The invention also relates to a swimming pool comprising a pool bottom, a peripheral upstanding pool wall having an interior side and an exterior side, the pool wall having at least one opening from the exterior side to the interior side of the pool wall, and an adjustable swimming pool floor system. The adjustable swimming pool floor comprises a buoyant pool floor adjustable in a height direction relative to the pool bottom of the swimming pool, at least one hydraulic system, comprising a hydraulic cylinder, comprising a cylinder barrel located at the exterior side of the pool wall and a piston rod, extending from the cylinder barrel, through the opening and into an interior of the swimming pool, and a sealing arrangement slideably enclosing a first part of the piston rod remote from the cylinder head, whereby the sealing arrangement is connected to at least the exterior side of the pool wall and located in or around the opening, the sealing arrangement preventing leakage of liquid from the swimming pool to the exterior side of the pool wall; the adjustable floor system further comprising a movement transfer arrangement provided at the interior of the swimming pool and connected at a first end to the first part of the piston rod extending into the interior of the swimming pool and at a second end to the buoyant pool floor, such that movement of the piston rod is transferred to the pool floor and adjustment of the pool floor in the height direction is achieved.

Preferably, the adjustable swimming pool floor system comprises a system as described above.

According to an embodiment, the opening in the pool wall is provided near the pool bottom. In such a way, the extending first part of the piston rod and the movement transfer arrangement can be positioned at an underside of the pool floor, such that the pool floor at least partly covers the first part of the piston rod extending into the swimming pool. In addition, the space required for the adjustable floor system is thereby reduced, as the space between the pool floor and the pool bottom can be kept at a minimum, i.e. the space required for the movement transfer arrangement and the extending part of the piston rod. A plurality of openings may be provide, each having an associated hydraulic system.

In a preferred embodiment, the movement transfer arrangement is of a type that converts a relatively small movement of the piston rod into a relatively large movement of the pool floor. This may be achieved using a pulley system having a high mechanical advantage or with another equivalent form of transmission.

Preferably, the sealing arrangement comprises a bush structurally engaged with the opening and extending through the pool wall.

According to an important aspect of the invention, the sealing arrangement comprise a layer of casting compound between the bush and a circumferential inner surface of the opening in the pool wall, connecting the bush and the circumferential inner surface of the opening. The bush may have a profiled outer surface whereby it is structurally engaged by the casting compound. Various casting compounds may be considered, in particular those that form a solid impervious connection to concrete. Preferably the casting compound comprises a two-component epoxy resin or other form of synthetic mortar.

In such an embodiment, upon removal of the hydraulic system, at least part of the bush remains in the opening. Upon removal of the hydraulic cylinder for replacement or maintenance, it is advantageous that the sealing arrangement can remain in the opening of the pool wall, such that the reconditioned or new hydraulic cylinder can be placed without having to reinstall the complete hydraulic system, i.e. including the sealing arrangement. In order to achieve this, the casting compound acts to connect the bush to the circumferential inner surface of the opening. Upon removal of the hydraulic cylinder, the first part of the piston rod is slid out of the bush, after first disconnecting the first part of the piston rod and the movement transfer arrangement.

In a further embodiment, the bush may comprise two or more sleeves with the outer sleeve permanently connected to the inner surface of the opening by the layer of casting compound. The inner sleeve can then be slid out of the outer sleeve together with the first part of the piston rod.

Preferably, the bush comprises a first radially extending flange at the exterior side of the pool wall and wherein the layer of casting compound extends from the interior side of the pool wall to the exterior side of the pool wall and further extends over at least the part of the exterior side of the pool wall covered by the first flange. Additionally, the bush can comprise an inner sleeve and an outer sleeve sealingly engaged with each other and the outer sleeve is structurally engaged within the opening, such the hydraulic system can be dismounted by withdrawing the inner sleeve from the outer sleeve, whereby the outer sleeve remains in the opening.

The hydraulic cylinder will generally have to be fixed near the pool wall after installation. According to an embodiment, the cylinder head is provided with connecting means for connecting the cylinder barrel to the first flange of the sealing arrangement, thereby mounting the cylinder barrel to the pool wall. This way of fixing the hydraulic cylinder is advantageous for pool walls that have a certain rigidity, due to their thickness and material properties, such as concrete pool walls. The pool wall is then used to not only carry the weight but also to transmit the reaction force of the cylinder barrel. In addition, the need to prepare a base floor with the same properties and strength as the pool wall is avoided.

In the case that the swimming pool has relatively thin and flexible pool walls, such as pool walls made of plate material, e.g. steel plate, the hydraulic cylinder may be fixed to a base floor at the exterior of the pool wall. In this embodiment, the cylinder barrel is provided with supports or connection means for connection to a base floor which may be parallel to the pool bottom. It will be understood that other constructions adjacent the exterior of the pool may be used to support and connect the cylinder barrel. Preferably, the sealing arrangement comprises a first flange at the exterior of the pool wall and a second flange at the interior side of the pool wall.

The invention furthermore relates to a method for installing a hydraulic system for an adjustable pool floor as described above. The method may comprise

- providing a buoyant pool floor and a hydraulic system for adjusting the buoyant pool floor in a height direction relative to the pool bottom, the hydraulic system comprising
  - a hydraulic cylinder, comprising a cylinder barrel and a piston rod, whereby a first part of the piston rod extends at an outside of the cylinder barrel beyond the cylinder head, and
  - a sealing arrangement slideably enclosing the first end of the piston rod, the method further comprising
- providing an opening from an exterior side to an interior side of the pool wall,
- sealingly connecting the sealing arrangement to the pool wall, whereby the sealing arrangement prevents liquid from leaking from the swimming pool,
- connecting the first part of the piston rod to the adjustable pool floor such that movement of the piston rod causes the pool floor to be adjusted in height.

For installing the adjustable pool floor system, the hydraulic system and the adjustable pool floor are installed at the exterior and the interior of the pool wall respectively. For installation of the hydraulic system, the pool wall is provided with an opening through which the first part of the piston rod can be extended into an interior of the swimming pool adjacent the interior side of the pool wall. The opening in the pool wall is preferably provided at a location near the pool bottom. In order to prevent the leakage of water from the swimming pool, the sealing arrangement enclosing the first part of the piston rod is connected to the pool wall. Then the movement transfer arrangement are mounted in the swimming pool and connected to the first end of the piston rod extending into the swimming pool. The adjustable pool floor can then be placed into the swimming pool and connected to the movement transfer arrangement.

Preferably, the sealing arrangement comprise a first radially extending flange, the method comprising connecting the first flange to the exterior side of the pool wall at the location of the opening, thereby covering part of the exterior side of the pool wall. The first flange functions both as a sealing element to block any liquid of the swimming pool coming through the pool wall, and as a connecting element between the hydraulic system and the swimming pool by fixing the first flange to the pool wall.

According to an embodiment, the sealing arrangement comprises a bush, slideably enclosing the first part of the piston rod and extending through the opening in the pool wall, the method comprising providing a layer of casting compound between the bush and a circumferential inner surface of the opening to structurally engage the bush within the opening.

Preferably, the method comprises providing a layer of casting compound from the interior side of the pool wall to the exterior side of the pool wall. The layer of casting compound may also extend over at least the part of the exterior side of the pool wall covered by the first flange. In order to avoid leakage via the interface between the sealing arrangement and the pool wall, the layer of casting compound may be provided along the whole inner circumferential surface of the opening from the interior side to the exterior side of the pool wall and at least the part of the exterior side of the pool wall covered by the first flange. When desired, the layer of sealing material can cover a larger area than the area covered by the radially extending first flange. Preferably, the bush comprises an inner sleeve and an outer sleeve and the method comprises connecting the outer sleeve and the circumferential inner surface of the opening with the layer of casting compound, whereby the hydraulic system can be removed by withdrawing the inner sleeve from the outer sleeve which remains within the opening.

As described above, the first flange can function as a connecting element between the hydraulic system and the swimming pool. To optimize this function, according to an embodiment, the method comprises connecting the cylinder barrel to the pool wall. This may be achieved using appropriate connections provided on the cylinder head for mounting the cylinder barrel to the first flange of the sealing arrangement. Such connections may include screws, bolts, anchors or the like. This way of fixing the hydraulic cylinder is advantageous for pool walls that have a certain rigidity, due to their thickness and material properties, such as concrete pool walls as discussed above.

According to another embodiment, the sealing arrangement may comprise a second flange and the method comprising connecting the second flange to the interior side of the pool wall opposite the first flange at the exterior side of the pool wall. This embodiment may be used for both relatively thick and relatively thin pool walls. In case of relatively thin walls, the sealing arrangement may comprise the first and second flanges and suitable gaskets to seal the opening in the pool wall with the piston rod extending through. The first and second flanges can than be connected to each other by suitable connecting means such as bolts through the pool wall and corresponding nuts for tightening the bolts In case the swimming pool wall is constructed of plate material, such as a metal plate, the method can comprise connecting the cylinder barrel to a base floor parallel to the pool bottom with connection means provided on the cylinder barrel. Relatively thin pool walls usually do not have the strength to be able to carry the load of a hydraulic cylinder. Therefore, a base floor can be constructed parallel to the pool bottom and the cylinder barrel may be provided with connection means that can be connected to the base floor. The load of the cylinder barrel is then supported by the base floor.

Preferably, the method further comprises supporting the sealing arrangement from the base floor, independently from the cylinder barrel.

Although the invention has been described in relation to an adjustable swimming pool floor system and a swimming pool comprising such a floor, it will be understood that individual parts of the system are new and inventive in their own right. The invention thus also relates to a hydraulic system as described above and hereafter for use in an adjustable swimming pool floor system and swimming pool.

DESCRIPTION OF ILLUSTRATIVE EMBODIMENTS

Figure 1:
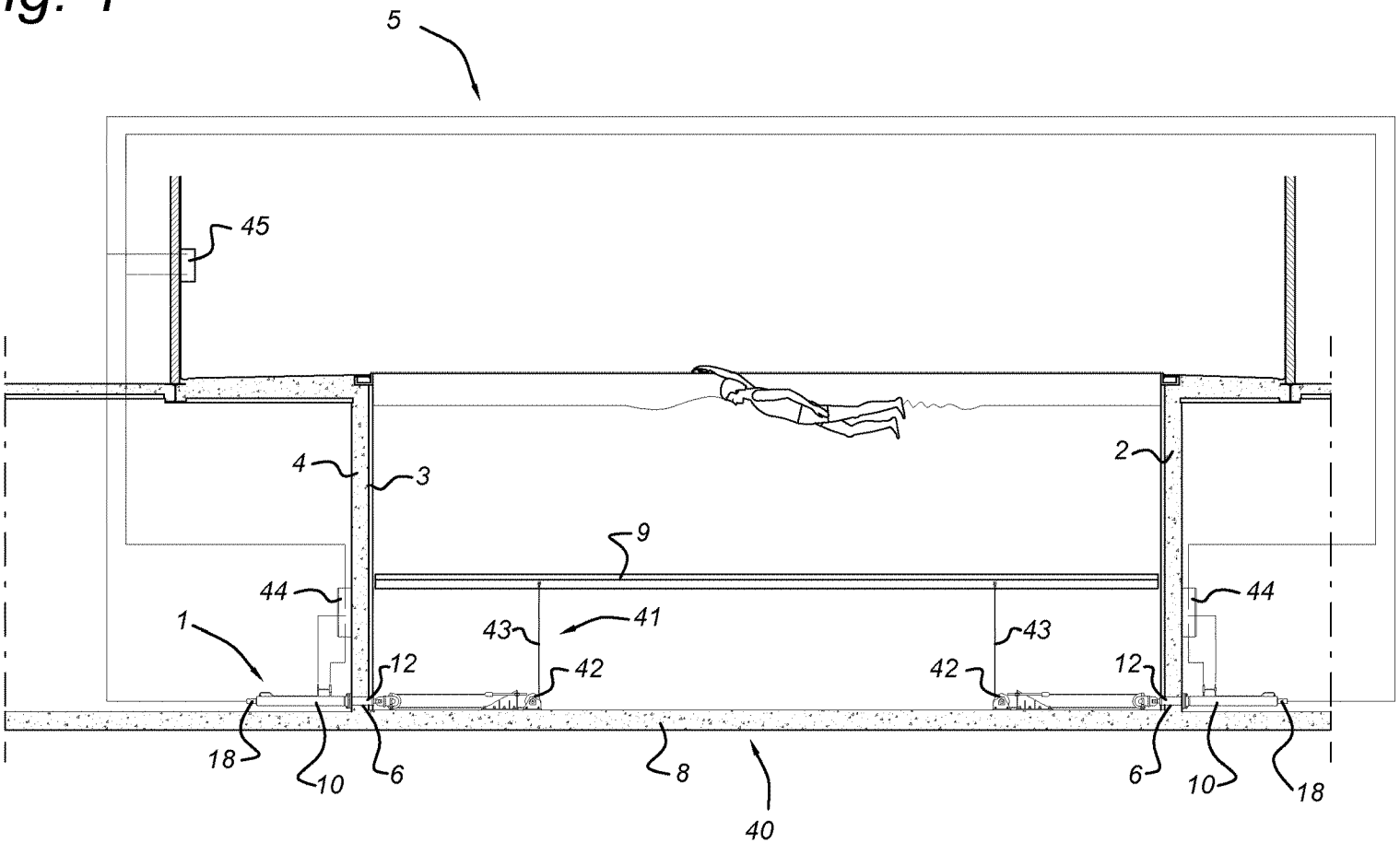
FIG. 1 shows a schematic overview of a swimming pool with an adjustable pool floor system according to an embodiment of the invention.

FIG. 1 shows a schematic overview of a swimming pool 5 with an adjustable pool floor system 40 installed. The swimming pool 40 has a pool bottom 8 and a peripheral upstanding pool wall 2 with an interior side 3 facing the interior of the swimming pool 5 and an exterior side 4 facing at least partly a space for installing the adjustable pool floor system 40.

The adjustable pool floor system comprises a buoyant pool floor 9 that is connected to a pulley system 41 for adjusting the height of the pool floor 9 with respect of the pool bottom 8, i.e. adjusting the depth of the swimming pool water. The pulley system 41 comprises a number of pulleys 42 and cables 43 for a steady movement of the pool floor 9 upon adjusting the depth of the swimming pool. The cable 43 is connected to a piston rod 12 of a hydraulic cylinder 10. The hydraulic cylinder 10 is part of a hydraulic system 1 described in more detail in FIG. 2. The piston rod 12 extends through an opening 6 in the pool wall 2 from the exterior side 4 to the interior side 3. The piston rod 12 is moved by actuating of the hydraulic cylinder by the pump 44. The pump 44 is connected to a control panel 45 for controlling the adjustment in height of the pool floor 9. The control panel 45 can be an electronic panel with push buttons or a computerized touch screen. The control panel 45 is connected to a detector 18 for detecting the movement of the piston rod 12 and the resulting height of the pool floor 9 relative to the pool bottom 8. The detector 18 is provided at the hydraulic cylinder and the control panel 45 is located in the vicinity of the swimming pool. The control panel 45 controls multiple hydraulic systems 1 connected to the pool floor 9, such that the pool floor is gradually adjusted in height.

Figure 2:
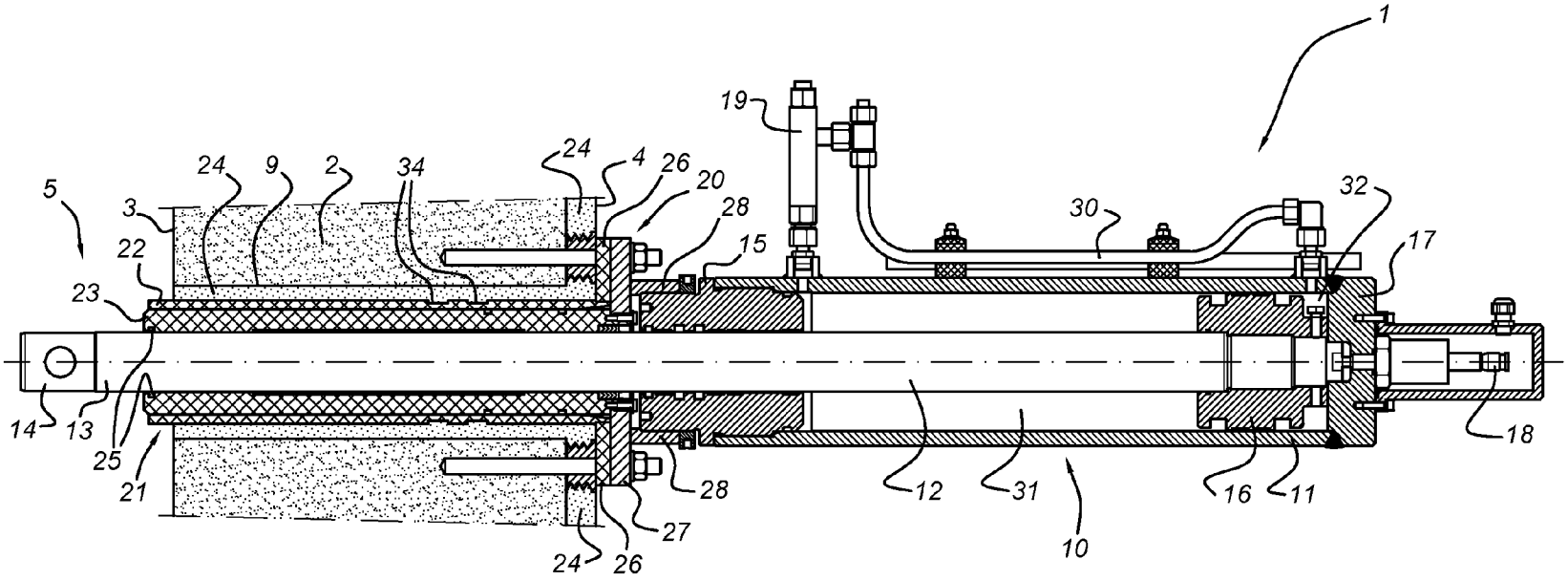
FIG. 2 shows a detailed cross-section of a hydraulic system according to FIG. 1.

FIG. 2 shows a cross-section of a hydraulic system 1 installed in a swimming pool 5. The hydraulic system comprises a hydraulic cylinder 10 and sealing means 20. The swimming pool 5 comprises a pool bottom 8 and a peripheral pool wall 2. In the pool wall 2 an opening 6 that extends from the interior side 3 to the exterior side 4 of the pool wall 2.

The hydraulic cylinder 10 comprises a cylinder barrel 11 extending from the exterior side 4 of the pool wall 2 and a piston rod 12 of which a first part 13 extends through the opening 6 in the pool wall 2. In addition, the hydraulic cylinder 10 comprises a cylinder head 15 closing off the opening in the cylinder barrel 11 facing the exterior side 4 of the pool wall 2, and a cylinder cap 17 closing off the opening of the cylinder barrel 11 facing away from the exterior side 4 of the pool wall 2. A piston 16 provided at the piston rod 12 is movable within the cylinder barrel 11 between the cylinder cap 17 and the cylinder head 15 and vice versa.

The sealing means 20 comprise a bush 21 that slideably encloses the first part 13 of the piston rod 12. The length of the bush 21 is relatively larger than the length of the opening 6 in the pool wall 2, defined by the distance between the interior side 3 and the exterior side 4 of the pool wall. The bush 21 comprises a first sleeve 23 slideably enclosing the first part of the piston rod 12. A second sleeve 22 encloses the first sleeve 23. In addition, a layer of potting material 24 that encloses the second sleeve 22 for sealing the space between the bush 21 and the pool wall 2 and connects the second sleeve 22 with the circumferential inner surface 9 of the opening 6 is provided. The potting material 24 may be a two-component epoxy resin, or a liquid ceramic compound, such as a cement, or a combination of the two.

The second sleeve 22 is connected to the inner surface 9 of the opening 6 by the potting material 24. The second sleeve 22 has circumferential grooves 34 for anchoring within the potting material 24. In addition, a first flange 27 is provided at the exterior side 4 of the pool wall 2. The first flange 27 extends in a radial direction from the piston rod 12 and covers a part of the exterior side 4 of the pool wall 2. Between the first flange 27 and the pool wall 2 a radially extending gasket 26 is provided adjacent the first flange 27. Furthermore, the potting material 24 is provided between the gasket 26 and the pool wall 2. The gasket 26 and the potting material 24 seal the space between the first flange 27 and the pool wall 2.

In order to avoid hydraulic fluid being transferred to the interior of the swimming pool 5, a wiping gasket 25 may be provided at the end of the first sleeve 23 facing the first end 14 of the piston rod 12, such that the hydraulic fluid is wiped off the piston rod 12 upon exiting the bush 21 and before entering the swimming pool 5.

The first part of the piston rod that extends through the opening 6 in the pool wall 2 has a first end 14. The buoyant pool floor 9 is connected to this first end 14 by means of a pulley system 41, as shown in FIG. 1. The buoyant pool floor 9 is adjustable in a height direction with respect to the pool bottom 8 by moving the piston 16 connected to the piston rod 17 within the cylinder barrel 11. The pump 44 actuates transport of the hydraulic fluid through the fluid connection tube 30 between a first part 31 and a second part 32 of the cylinder barrel separated by the piston 16, such that the hydraulic fluid pressure in the separate parts 31, 32 is varied for the piston to move within the cylinder barrel under the influence of the pressure change. The fluid connection tube 30 is provided at an exterior of the cylinder barrel 11. A non-return valve 19 is connected to the fluid connection tube 30 at the first part of the cylinder barrel for maintaining the pressure in the cylinder barrel 11 in the unlikely event of failure of the pump 4 or a leakage of hydraulic fluid elsewhere in the hydraulic system.

The height of the pool floor 9 with respect to the pool bottom 8 (and therefore the depth of the swimming pool) is detected by a detector 18 that communicates with the control panel 45. The detector is provided at the cylinder cap 17 and extends from the interior of the cylinder barrel adjacent the cylinder cap to an exterior beyond the cylinder cap 17 in a direction parallel to the piston rod 12. The detector 18 is a linear detector and measures the distance between the piston 16 and the cylinder cap 17. This distance has a linear relationship with the height of the pool floor 9 with respect to the pool bottom 8 or the depth of the pool floor 9 with respect to an upper edge of the pool wall 2.

The hydraulic barrel 11 is connected to the pool wall 2 by a connection with the first flange 27. This connection is possible if the pool wall is a concrete pool wall with sufficient thickness. The first flange 27 is provided with a cylindrical connection element 28 that extends over and is connected to the cylinder head 15. The connection between the first flange 27 and the cylinder head 15 is a strong connection, such that support of the cylinder barrel 11 provided on a base floor 33 (shown in FIG. 4) is not necessary.

Figure 3:
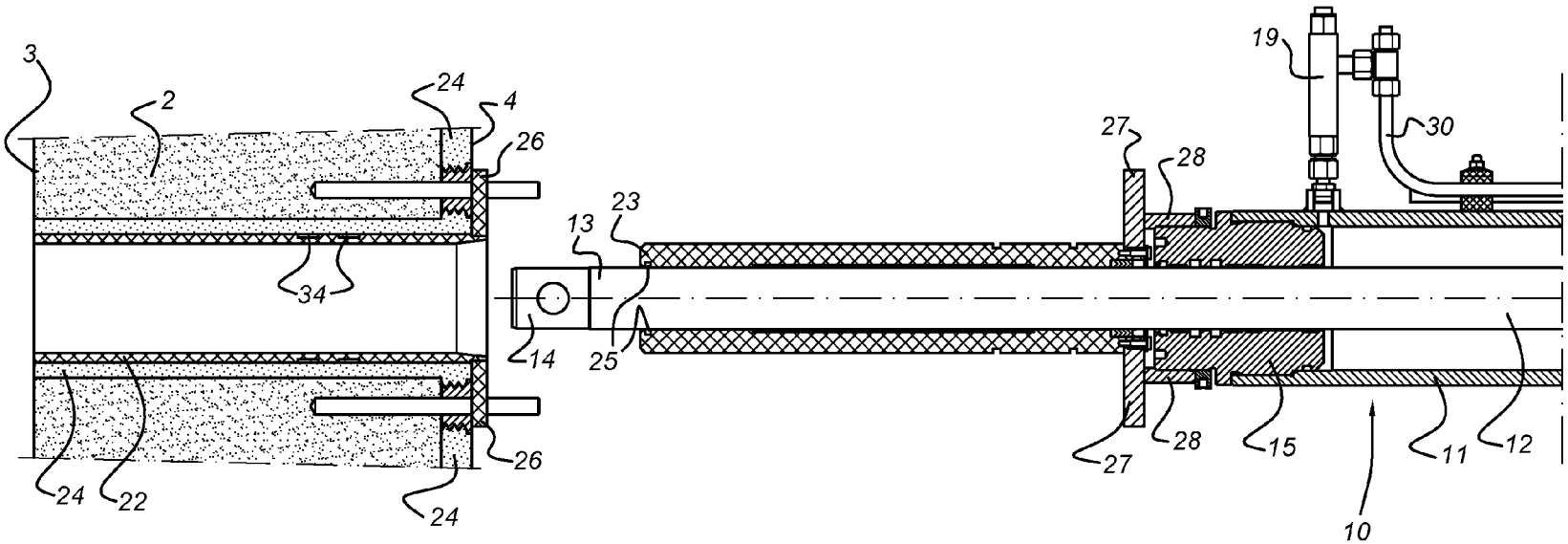
FIG. 3 shows the hydraulic system of FIG. 2 removed for maintenance or replacement.

FIG. 3 shows the hydraulic system of FIG. 2 removed for maintenance or replacement. The nuts that fix the first flange 27 to the pool wall are removed. The first flange 27 is then slid over the bolts and the piston rod 12 with the first sleeve 23 is simultaneously slid from the opening 6. The piston rod 12 with the first sleeve 23 is then taken out from the opening 6. The second sleeve 22 is connected to the opening 6 by the potting material 24 and remains in the opening 6. The resulting opening between the interior side 3 and the exterior side 4 of the pool wall is then closed with a plug or the like (not shown). The gasket 26 and the potting material 24 at the exterior side 4 of the pool wall 2 remain connected to the exterior side 4 of the pool wall 2.

Figure 4:
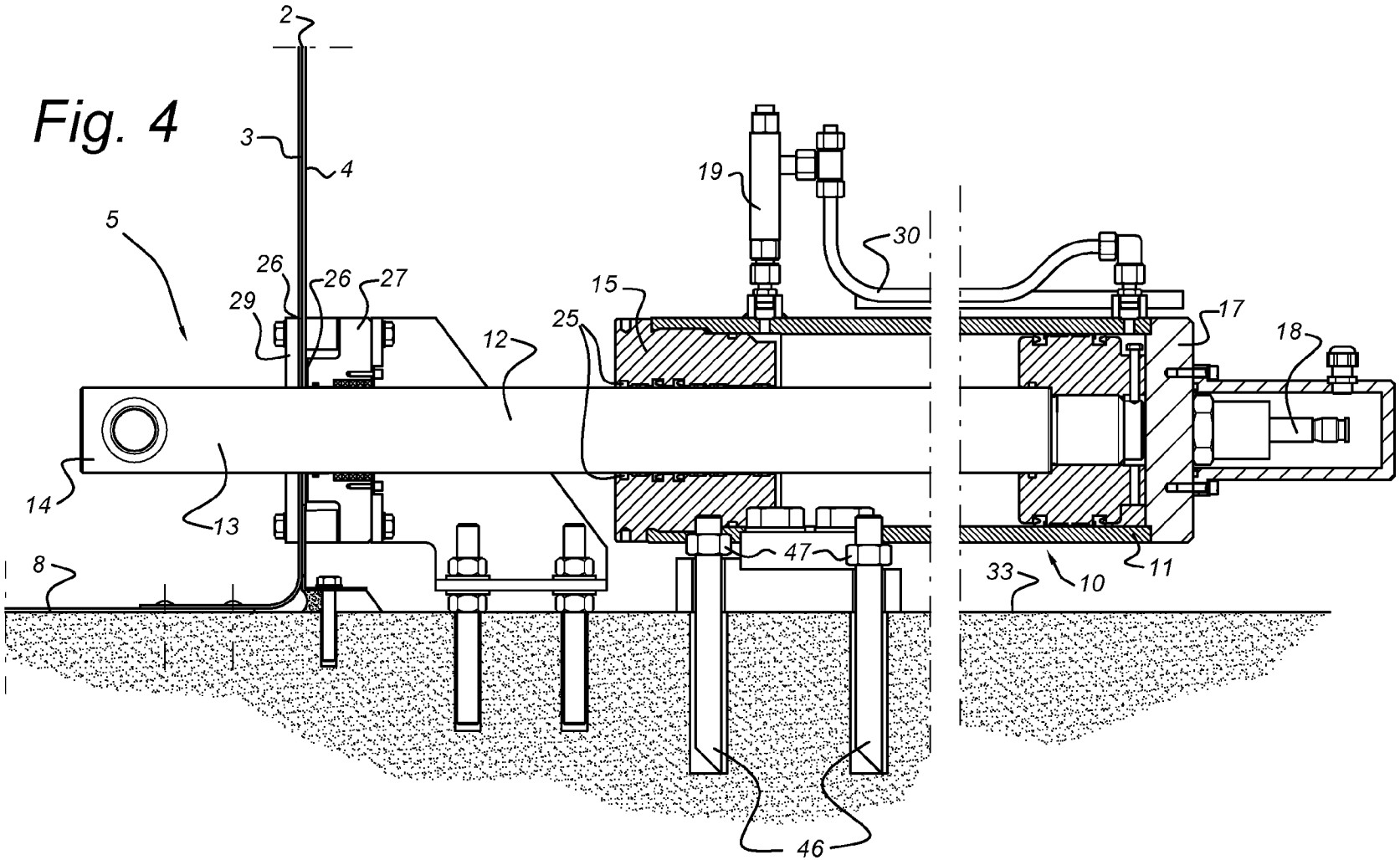
FIG. 4 shows a detailed cross-section of a hydraulic system according a second embodiment installed in a swimming pool.

FIG. 4 shows a detailed cross-section of a second embodiment of the hydraulic system 1 of the adjustable floor system 40 installed in a swimming pool 5. The swimming pool 5 is constructed from plate material, for instance a metal plate. The pool wall 2 is therefore relatively thin and does not have sufficient strength to support the cylinder barrel 11. The piston rod 12 extends through the opening 6 from an exterior side 4 to an interior side 3 of the pool wall 2. The first flange 27 encloses the piston rod 12 and extends in a radial direction from the piston rod 12. The first flange 27 is connected to the exterior side 4 of the pool wall 2. Between the pool wall 2 and the first flange 27 a gasket 26 is provided. At the interior side 3 of the pool wall 2 a second flange 29 is provided and connected to the pool wall 2. Between the pool wall 2 and the second flange 29 a further gasket 26 is provided. The first and second flanges are thus located at the opening 6 but at opposite sides, i.e. the second flange 29 is a counterflange of the first flange 27. The opening 6 is sealed by tightly connecting the first and second flanges 27, 29 to the pool wall 2 such that the gaskets 26 seal off the opening 6.

Furthermore, the cylinder barrel 11 is connected to a base floor 33. The cylinder barrel 11 is therefore provided with flanges that can be connected to bolts 46 provided in the base floor. The base floor 33 and the cylinder barrel 11 are fixed together by tightening nuts 47 corresponding to the bolts 46. The hydraulic cylinder 10 is then supported by the base floor 33. The cylinder head 15 is positioned remote from the first and second flanges 27, 29, such that the piston rod 12 runs freely and uncovered between the first flange 27 and the cylinder head 15 at the exterior side 4 of the swimming pool 5. In order to avoid hydraulic fluid being transferred to the interior of the swimming pool 5, a wiping gasket 25 may be provided at the cylinder head 15, such that the hydraulic fluid is wiped off the piston rod 12 upon exiting the cylinder barrel 11 and before entering the first flange 27.

| LIST OF PARTS |
|---|
| 1. Hydraulic system |
| 2. Pool wall |
| 3. Interior side pool wall |
| 4. Exterior side pool wall |

-continued

| LIST OF PARTS |
|---|
| 5. Swimming pool |
| 6. Opening |
| 7. — |
| 8. Pool bottom |
| 9. Pool floor |
| 10. Hydraulic cylinder |
| 11. Cylinder barrel |
| 12. Piston rod |
| 13. First part of piston rod |
| 14. First end of piston rod |
| 15. Cylinder head |
| 16. Piston |
| 17. Cylinder cap |
| 18. Detector |
| 19. Non-return valve |
| 20. Sealing arrangement |
| 21. Bush |
| 22. Second sleeve |
| 23. First sleeve |
| 24. Potting material |
| 25. Wiping gasket |
| 26. Gasket |
| 27. First flange |
| 28. Cylinder head connection flange |
| 29. Second flange |
| 30. Fluid connection tube |
| 31. First part of cylinder barrel |
| 32. Second part of cylinder barrel |
| 33. Base floor |
| 34. Circumferential groove |
| 40. Adjustable pool floor system |
| 41. Pulley system |
| 42. Pulley |
| 43. Cable |
| 44. Pump |
| 45. Control panel |
| 46. Connecting bolts |
| 47. Connecting nuts |

The invention claimed is:

1. Adjustable swimming pool floor system, comprising:

a buoyant pool floor adjustable in a height direction relative to a pool bottom of a swimming pool:

a hydraulic system comprising:

a hydraulic cylinder, comprising a cylinder barrel having a cylinder head and a cylinder cap, a piston slideably arranged within the cylinder barrel and a piston rod carried by the piston, whereby a first part of the piston rod extends at an outside of the cylinder barrel beyond the cylinder head; and a sealing arrangement slideably enclosing the first part of the piston rod remote from the cylinder head, whereby the sealing arrangement is connectable with an opening extending through a peripheral pool wall enclosing the swimming pool, from an exterior side to an interior side of the pool wall for extending the first part of the piston rod into an interior of the swimming pool adjacent the interior side of the pool wall, the sealing arrangement preventing leakage of liquid from the swimming pool to the exterior side of the pool wall and comprising a bush slideably enclosing the first part of the piston rod and extending in an axial direction over a length corresponding to a distance between the exterior side and the interior side of the pool wall, wherein the bush comprises an outer sleeve of polymer material slideably enclosing an inner sleeve of polymer material with the first part of the piston rod slideably enclosed by the inner sleeve, and the polymer material of the outer sleeve being a harder polymer material than the polymer material of the inner sleeve;

the adjustable floor system further comprising:

a movement transfer arrangement connectable at a first end to the first part of the piston rod extendable into the interior of the swimming pool and at a second end to the buoyant pool floor, such that in use movement of the piston rod is transferred to the pool floor and adjustment of the pool floor in the height direction is achieved.

2. Adjustable swimming pool floor system according to claim 1, wherein the movement transfer arrangement comprises a pulley system connected between the first end of the piston rod and the pool floor, whereby the pulley system applies tension to the piston rod in a direction aligned with the piston rod movement and converts a horizontal movement of the piston rod into a movement of the pool floor in the height direction.

3. Adjustable swimming pool floor system according to claim 1, wherein the inner sleeve comprises high density polyethylene (HDPE), and the outer sleeve comprises polyvinylchloride (PVC).

4. Adjustable swimming pool floor system according to claim 1, wherein a wiping element is provided at an end of the bush adjacent the interior side of the pool wall, the wiping element being arranged for wiping the first part of the piston rod as it enters the swimming pool.

5. Adjustable swimming pool floor system according to claim 1, comprising a detector for detecting a position of the piston rod with respect to the cylinder.

6. Adjustable swimming pool floor system according to claim 5, wherein the detector measures a distance from the detector to the piston and the detector is provided at the cylinder cap.

7. Adjustable swimming pool floor system according to claim 1, further comprising a processor controlled hydraulic circuit for causing movement of the piston within the cylinder barrel and a user interface for selecting a height of the pool floor relative to the pool bottom.

8. Adjustable swimming pool floor system according to claim 7, wherein the piston divides an interior of the cylinder barrel into a first part between the piston and the cylinder head and a second part between the piston and the cylinder cap and the hydraulic circuit comprises a fluid connection between the first and the second part of the interior of the cylinder barrel, whereby the fluid connection is provided at an exterior of the cylinder barrel.

9. Adjustable swimming pool floor system according to claim 8, wherein the cylinder barrel is provided with a non-return valve arranged to maintain pressure in the interior of the cylinder barrel in the event of failure of the hydraulic circuit.

10. Adjustable swimming pool floor system according to claim 1, wherein the sealing arrangement comprises a radially extending first flange connectable to the exterior side of the pool wall.

11. Adjustable swimming pool floor system according to claim 10, wherein the sealing arrangement comprises a second flange connectable to the interior side of the pool wall, opposite the first flange at the exterior side of the pool wall.

12. Adjustable swimming pool floor system according to claim 11, wherein a wiping element is provided at the cylinder head, such that in use, hydraulic fluid is wiped off the piston rod upon exiting the cylinder barrel and prior to entering the sealing element.

13. Swimming pool comprising a pool bottom, a peripheral upstanding pool wall having an interior side and an exterior side, the pool wall having at least one opening from the exterior side to the interior side of the pool wall, and an adjustable swimming pool floor system, comprising a buoyant pool floor adjustable in a height direction relative to the pool bottom of the swimming pool, at least one hydraulic system, comprising a hydraulic cylinder, comprising a cylinder barrel located at the exterior side of the pool wall and a piston rod, extending from the cylinder barrel, through the opening and into an interior of the swimming pool, and a sealing arrangement, connected to the pool wall, comprising a bush structurally engaged within the opening and extending through the pool wall, wherein the bush comprises an inner sleeve of a polymer material and an outer sleeve of a polymer material which is a harder polymer material than the polymer material of the inner sleeve, wherein the sealing arrangement slideably encloses a first part of the piston rod, to prevent leakage of liquid from the swimming pool to the exterior side of the pool wall, wherein the cylinder barrel is connected to the sealing arrangement, thereby mounting the cylinder barrel to the pool wall;

the adjustable swimming pool floor system further comprising a movement transfer arrangement provided at the interior of the swimming pool and connected at a first end to the first part of the piston rod extending into the interior of the swimming pool and at a second end to the buoyant pool floor, such that movement of the piston rod is transferred to the pool floor and adjustment of the pool floor in the height direction is achieved.

14. Swimming pool according to claim 13, wherein the adjustable swimming pool floor system comprises a system according to claim 7.

15. Swimming pool according to claim 13, wherein at least one opening through the pool wall is provided near the pool bottom.

16. Swimming pool according to claim 13, wherein the movement transfer arrangement converts a small movement of the piston rod into a large movement of the pool floor.

17. Swimming pool according to claim 13, wherein the bush comprises an inner sleeve and an outer sleeve sealingly engaged with each other and the outer sleeve is structurally engaged within the opening, such the hydraulic system can be dismounted by withdrawing the inner sleeve from the outer sleeve, whereby the outer sleeve remains in the opening.

18. Swimming pool according to claim 13, wherein the pool wall comprises a concrete wall.

19. Swimming pool according to claim 13, wherein the sealing arrangement comprise a first flange at the exterior side of the pool wall and a second flange at the interior side of the pool wall.

20. Swimming pool according to claim 13, wherein the bush comprises a profiled outer surface and a volume of casting compound is provided between the bush and the pool wall to structurally engage the bush within the opening.

21. Swimming pool according to claim 20, wherein the bush comprises a first radially extending flange at the exterior side of the pool wall and wherein the layer of casting compound extends from the interior side of the pool wall to the exterior side of the pool wall and further extends over at least the part of the exterior side of the pool wall covered by the first flange.

22. Method for installing a hydraulic system for an adjustable pool floor in a swimming pool comprising a pool bottom and a circumferential upstanding pool wall, the method comprising:

providing a buoyant pool floor and a hydraulic system for adjusting the buoyant pool floor in a height direction relative to the pool bottom, the hydraulic system comprising a hydraulic cylinder, comprising a cylinder barrel and a piston rod, whereby a first part of the piston rod extends out of the cylinder barrel, and a sealing arrangement slideably enclosing the first part of the piston rod, the method further comprising providing an opening from an exterior side to an interior side of the pool wall, sealingly connecting the sealing arrangement to the pool wall, whereby the sealing arrangement prevents liquid from leaking from the swimming pool, wherein the sealing arrangement comprises a first radially extending flange and the method comprises connecting the first flange to the exterior side of the pool wall at the location of the opening, thereby covering part of the exterior side of the pool wall and mounting the cylinder barrel to the pool wall across the first flange; and connecting the first part of the piston rod to the adjustable pool floor such that movement of the piston rod causes the pool floor to be adjusted in height, wherein the sealing arrangement comprises a bush, slideably enclosing the first part of the piston rod and extending through the opening in the pool wall, wherein the bush comprises an inner sleeve of polymer material and an outer sleeve of polymer material with the polymer material of the outer sleeve being harder than the polymer material of the inner sleeve.

23. Method according to claim 22, comprising providing a layer of casting compound from the interior side of the pool wall to the exterior side of the pool wall and over at least a part of the exterior side of the pool wall covered by the first flange.

24. Method according to claim 22, wherein the sealing arrangement comprises a second flange, the method comprising connecting the second flange to the interior side of the pool wall opposite the first flange at the exterior side of the pool wall.

25. Method according to claim 22, comprising providing a layer of casting compound between the bush and a circumferential inner surface of the opening to structurally engage the bush within the opening.

26. Method according to claim 25, comprising connecting the outer sleeve and the circumferential inner surface of the opening with the layer of casting compound, whereby the hydraulic system can be removed by withdrawing the inner sleeve from the outer sleeve which remains within the opening.

* * * * *